US006443160B1

(12) United States Patent
Boldrini et al.

(10) Patent No.: US 6,443,160 B1
(45) Date of Patent: Sep. 3, 2002

(54) METHOD AND DEVICE FOR FORMING A CIGARETTE ROD CONTAINING AN ADDITIVE MATERIAL

(75) Inventors: Fulvio Boldrini, Ferrara; Massimo Sartoni; Davide Dall'Osso, both of Bologna, all of (IT)

(73) Assignee: G.D. S.p.A., Bologna (IT)

( * ) Notice: Subject to any disclaimer, the term of this patent is extended or adjusted under 35 U.S.C. 154(b) by 0 days.

(21) Appl. No.: 09/458,953

(22) Filed: Dec. 10, 1999

(30) Foreign Application Priority Data

Dec. 15, 1998 (IT) ..... B098A0695

(51) Int. Cl.[7] ..... A24B 15/00; A24B 15/28; A24C 5/00; A24C 5/14

(52) U.S. Cl. ..... 131/280; 131/31; 131/32; 131/62; 131/79; 131/84.1; 131/84.3

(58) Field of Search ..... 131/280, 282, 131/275, 274, 27.1, 31, 32, 58, 60, 62, 77, 89.1, 84.3, 79, 108, 109.1, 110, 910; 493/3, 48

(56) References Cited

U.S. PATENT DOCUMENTS

| | | | | |
|---|---|---|---|---|
| 2,682,270 A | * | 6/1954 | Schur | |
| 3,259,029 A | * | 7/1966 | Hall et al. | |
| 3,446,404 A | * | 5/1969 | Mehta | |
| 3,570,557 A | * | 3/1971 | Molins | |
| 3,656,518 A | * | 4/1972 | Aronson | |
| 3,844,200 A | * | 10/1974 | Sexstone | |
| 3,847,064 A | * | 11/1974 | Berger | |
| 4,005,668 A | * | 2/1977 | Washington et al. | |
| 4,411,640 A | * | 10/1983 | Hall | |
| 4,681,124 A | * | 7/1987 | Hinzmann et al. | 131/109.1 |
| 4,862,905 A | * | 9/1989 | Green, Jr, et al. | 131/84.1 |
| 5,012,823 A | * | 5/1991 | Keritsis et al. | 131/31 |
| 5,474,092 A | * | 12/1995 | Moser et al. | 131/280 |
| 6,170,489 B1 | * | 1/2001 | Hoppe et al. | 131/109.1 |
| 6,273,093 B1 | * | 8/2001 | Oliver et al. | 131/108 |

FOREIGN PATENT DOCUMENTS

| | | | |
|---|---|---|---|
| EP | 2 095 518 | | 12/1988 |
| FR | 1.554.073 | | 1/1969 |
| GB | 1144623 | * | 3/1969 |
| GB | 2 229 079 A | | 9/1990 |
| GB | 2 260 887 A | | 5/1993 |
| WO | 98/36650 | | 8/1998 |

* cited by examiner

*Primary Examiner*—Jose Fortuna
*Assistant Examiner*—Carlos Lopez
(74) *Attorney, Agent, or Firm*—The Law Offices of Timothy J. Klima

(57) ABSTRACT

The invention relates to a method for forming a cigarette rod containing an additive material in a cigarette making machine, in which a continuous tobacco rod is fed along a vacuum conveyor and particles of the additive material are fed to and incorporated along the axis of the cigarette rod by a distributor which comprises a conveyor having a hollow drum with a cylindrical side wall on which there is a plurality of seats designed to house the particles; the drum rotating within a ring-shaped structure and the seats, during rotation of the drum, passing through an ejector unit designed to eject the particles from the seats and incorporate them in the tobacco rod through a feed pipe, so as to control the distribution of the particles of the additive material along the tobacco rod, obtaining a preset positioning of the particles in each cigarette length.

17 Claims, 6 Drawing Sheets

26a
26
27
28
34
30
47
59
32
25
33
29
11
3
7
10
57
13
12
1
14
10a
2
9
19
18
20
22
24
21
23
61
58
16
17a
4
17
15
60
5
8
6
62
42
d

METHOD AND DEVICE FOR FORMING A CIGARETTE ROD CONTAINING AN ADDITIVE MATERIAL

BACKGROUND OF THE INVENTION

The present invention relates to a method for forming a cigarette rod containing an additive material.

The present invention is advantageously applied in the sector of cigarette making machines, both with a single and a double line, and in particular for making cigarette lengths obtained by wrapping a web of paper around a continuous tobacco rod which is formed along a vacuum conveyor, in order to create a continuous cigarette rod which is subsequently cut into cigarette lengths.

The practice of including particles of an additive material in the tobacco, which changes the flavor of the smoke when the cigarette burns, is known in the production of cigarettes.

For this reason, cigarette making machines often incorporate the additive material in the cigarette rod, for example in the form of microcapsules, distributed at random and with average preset concentrations, but without effective control of their local distribution in the cigarette rod.

SUMMARY OF THE INVENTION

The aim of the present invention is to provide a method and device which allow the distribution of the particles of the additive material and their quantity or number to be controlled.

Another aim of the present invention is to provide a method and device which allow the obtainment of a preset distribution of said particles along the cigarette rod, or alternatively allow the distribution of such particles of the additive material at preset zones of the cigarette rod.

Accordingly, the present invention provides a method for the production of a cigarette rod containing particles of an additive material, in a cigarette making machine, including stages of feeding particles of tobacco to a vacuum conveyor, which moves at a preset speed, in order to form a continuous tobacco rod, incorporating the particles of the additive material in the tobacco rod as it is formed, feeding the tobacco rod to a station which forms a continuous cigarette rod, the particles of the additive material being positioned substantially along the axis of the cigarette rod, and cutting the cigarette rod into lengths using a rotary cutting device designed to cyclically cut the rod at transversal cutting lines, wherein the stage of incorporating the particles of the additive material in the tobacco rod comprises stages of feeding the particles of the additive material to a distributor having a rotary conveyor with distribution seats on one of its outer surface, ejecting the particles of the additive material towards the tobacco rod from the rotary conveyor through at least one ejection channel.

The present invention also relates to a device for the production of a cigarette rod containing particles of an additive material.

Accordingly, the present invention provides a device for the production of a cigarette rod containing particles of an additive material, having a vacuum conveyor designed to form a tobacco rod to be fed to a station which forms a continuous cigarette rod, a device for incorporating the particles of the additive material in the tobacco rod, a rotary cutting device for cutting the cigarette rod at transversal cutting lines, so as to form lengths, the device comprising a rotary conveyor with distribution seats on one of its outer walls, ejector means, located in a fixed position relative to the conveyor, designed to eject a given quantity of particles of the additive material when the conveyor carrying the particles of the additive material arrives at the position of the ejector means, feed means for transferring the particles of the additive material from the ejector means to a zone close to the vacuum conveyor designed to form a tobacco rod.

BRIEF DESCRIPTION OF THE DRAWINGS

The invention will now be described with reference to the accompanying drawings, which illustrate a preferred embodiment of the invention without limiting the scope of its application, and in which.

DESCRIPTION OF THE PREFERRED EMBODIMENTS

Figures 1, 2:
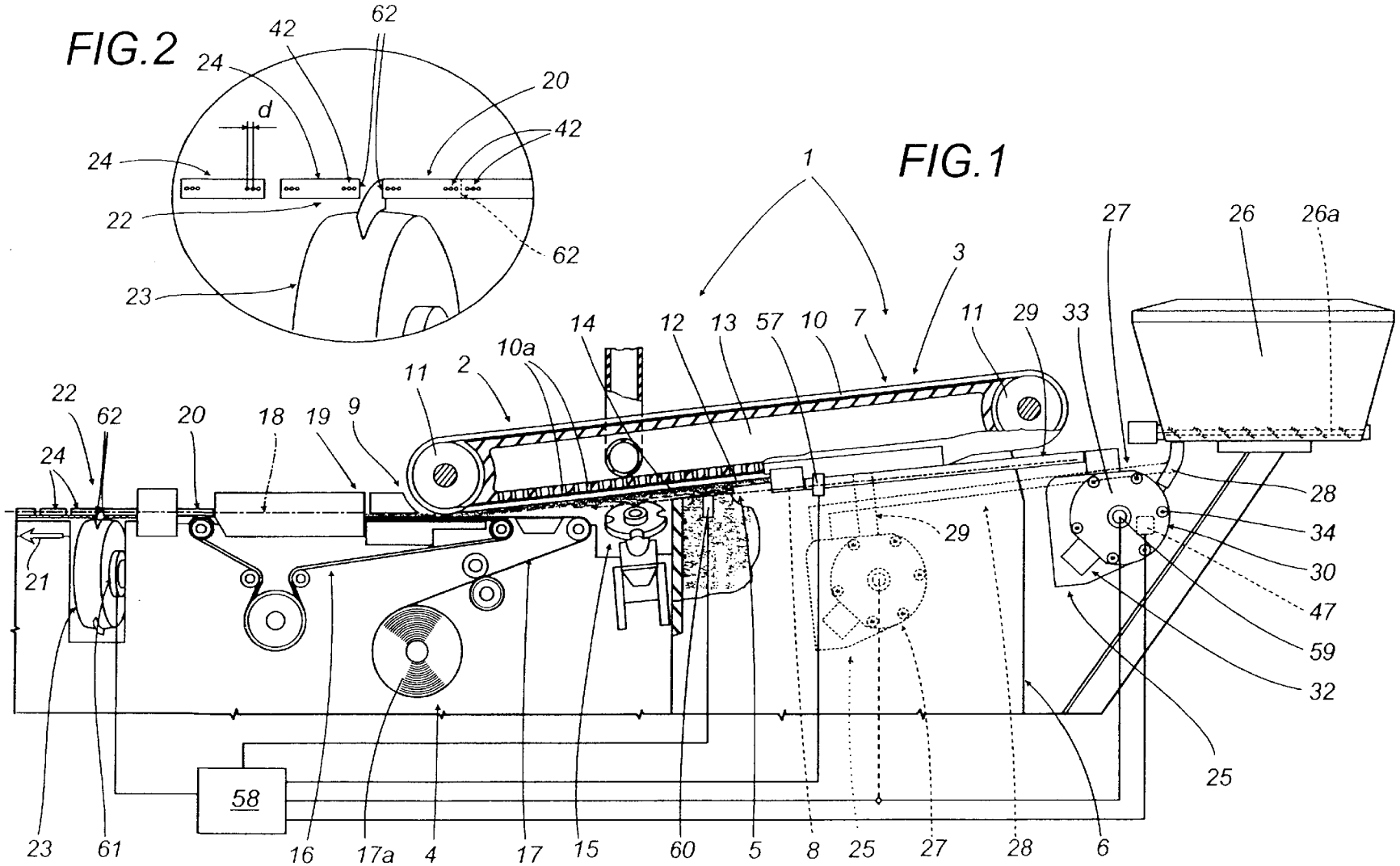
FIG. 1 is a schematic side view, partially in blocks and with some parts cut away for the purpose of clarity, of a portion of a cigarette making machine equipped with a device made in accordance with the present invention.
FIG. 2 is a scaled-up schematic view of a detail from FIG. 1.

With reference to FIG. 1, the numeral 1 indicates as a whole a portion of a cigarette making machine comprising a single cigarette making line 2, the line comprising a tobacco feed unit 3 and a paper feed unit 4.

Figure 7:
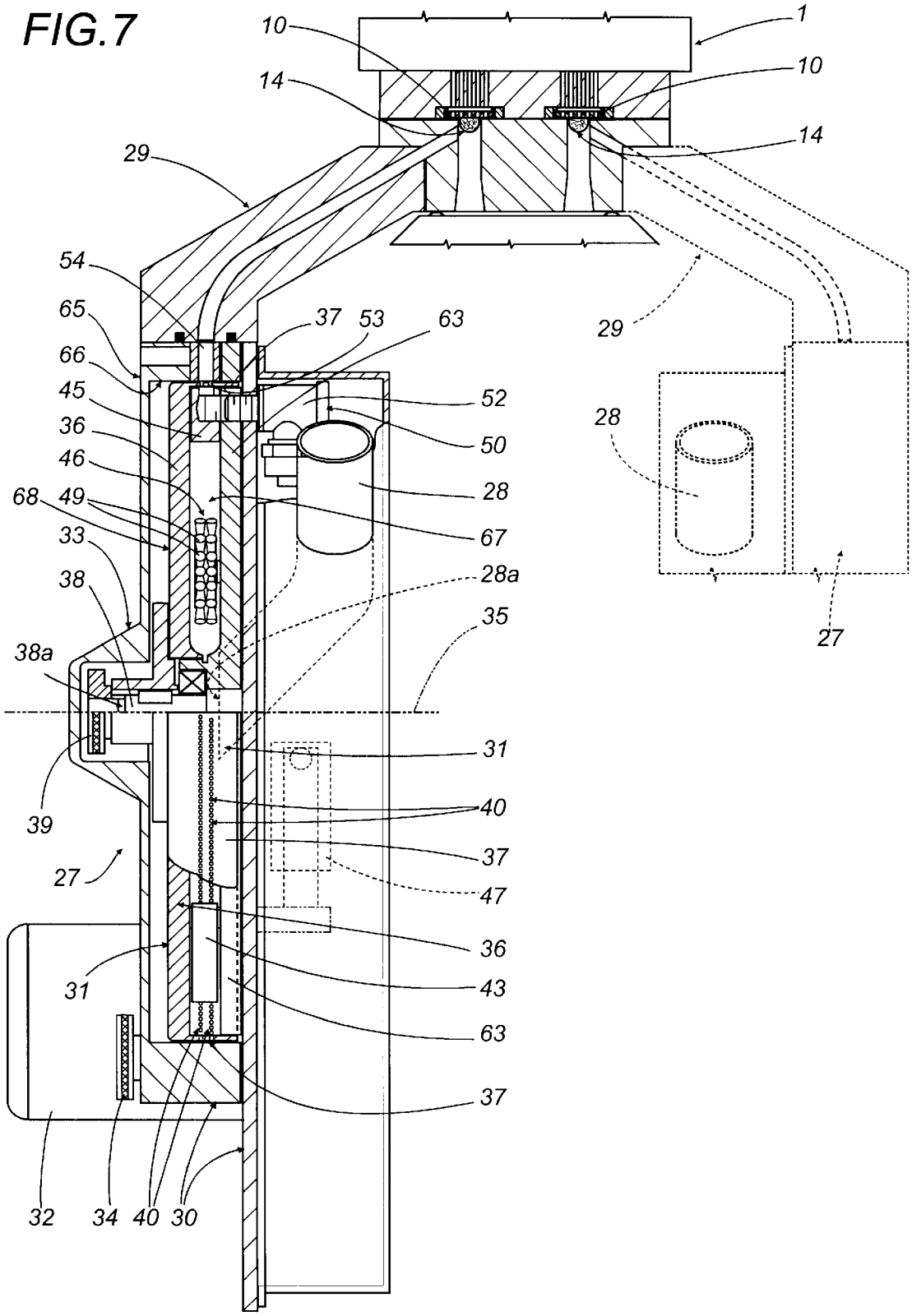
FIG. 7 is side view in direction VII illustrated in FIG. 6, with some parts in cross-section and others cut away for the purpose of clarity, of the device in accordance with the present invention.

In the description which follows, reference is made to a machine with a single cigarette making line, although it may be extended to cover a machine with a two cigarette making lines, illustrated in FIG. 7, since the twin lines 2 operate in a parallel fashion and are positioned side-by-side, substantially symmetrical with one another relative to a vertical plane.

Only the end part of the unit 3 is illustrated, comprising an outlet 5 of an ascending shaft 6 and a vacuum conveyor 7 which extends, along a tobacco transfer path 8, from the outlet 5 to a tobacco unloading station 9.

The conveyor 7 comprises a belt 10 which is wound in a loop around two rollers 11 with substantially horizontal axes and defining a lower conveyor branch 12 and a vacuum chamber 13, located between the two rollers 11 inside the loop and designed to create a vacuum inside the shaft 6, through the outlet 5 and a plurality of through-holes 10*a* in the belt 10, so as to form a continuous tobacco rod 14 which adheres to the branch 12.

Along the tobacco transfer path 8, below the branch 12, is a rotary trimmer device 15, designed to remove (in the known way) excess tobacco from the tobacco rod 14 so that the tobacco rod 14 has a preset thickness.

The paper feed unit 4 comprises a conveyor belt 16 designed to hold a web 17 of paper by means of a vacuum as the web is unwound from a reel 17*a* and to feed it along a path 18 extending through the tobacco unloading station 9, where the tobacco rod 14 which has just been trimmed is deposited on the web 17.

Along the path 18 there is a forming beam 19, of the known type, designed to wrap the web 17 about the tobacco rod 14. Along the forming beam 19, the two longitudinal edges of the web 17 are overlapped and glued to one another (in the known way, therefore, not illustrated), to form a continuous cigarette rod 20.

The path 18 extends, downstream of the beam 19 and in a direction of feed 21 of the cigarette rod 20, through a cutting station 22, in which a rotary cutting device 23 is designed to cut the rod 20 cyclically and transversally along transversal cutting lines 62, so that the rod 20 is cut into cigarette lengths 24, each with a constant given length.

The cigarette making line 2 comprises a device, labeled 25 as a whole, for incorporating particles 41 of an additive material in the cigarette rod 20.

The device 25 basically comprises a tank 26 and a distributor 27, which may be positioned close to the tank 26 beside the ascending shaft 6, as illustrated by the continuous line in FIG. 1, or may be positioned close to the center line of the ascending shaft 6, as illustrated by the dashed line in FIG. 1.

Figure 3:
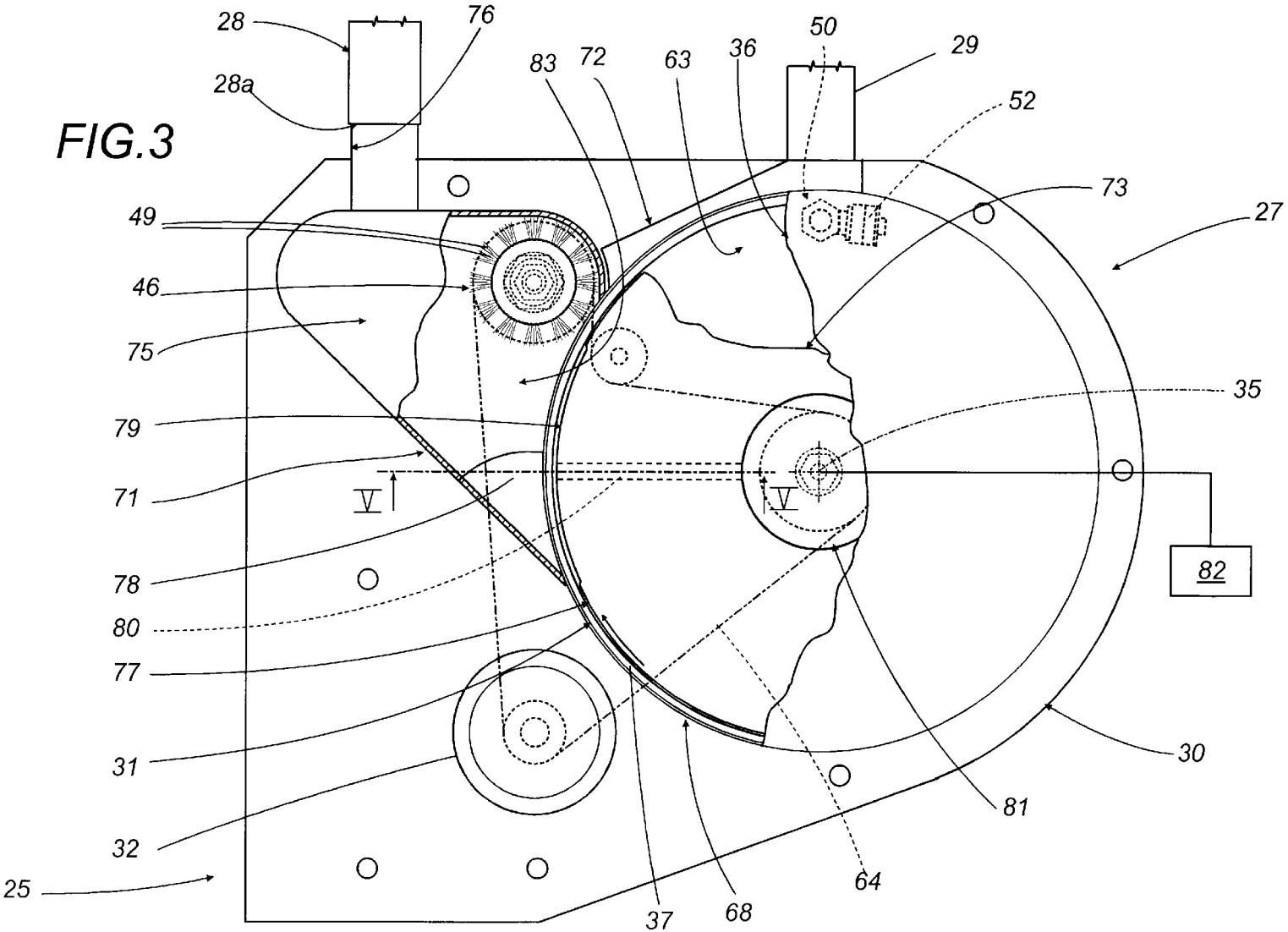
FIG. 3 is a schematic front view with some parts shown in cross-section and others cut away for the purpose of clarity, of a first preferred embodiment of the device in accordance with the present invention.
Figure 6:
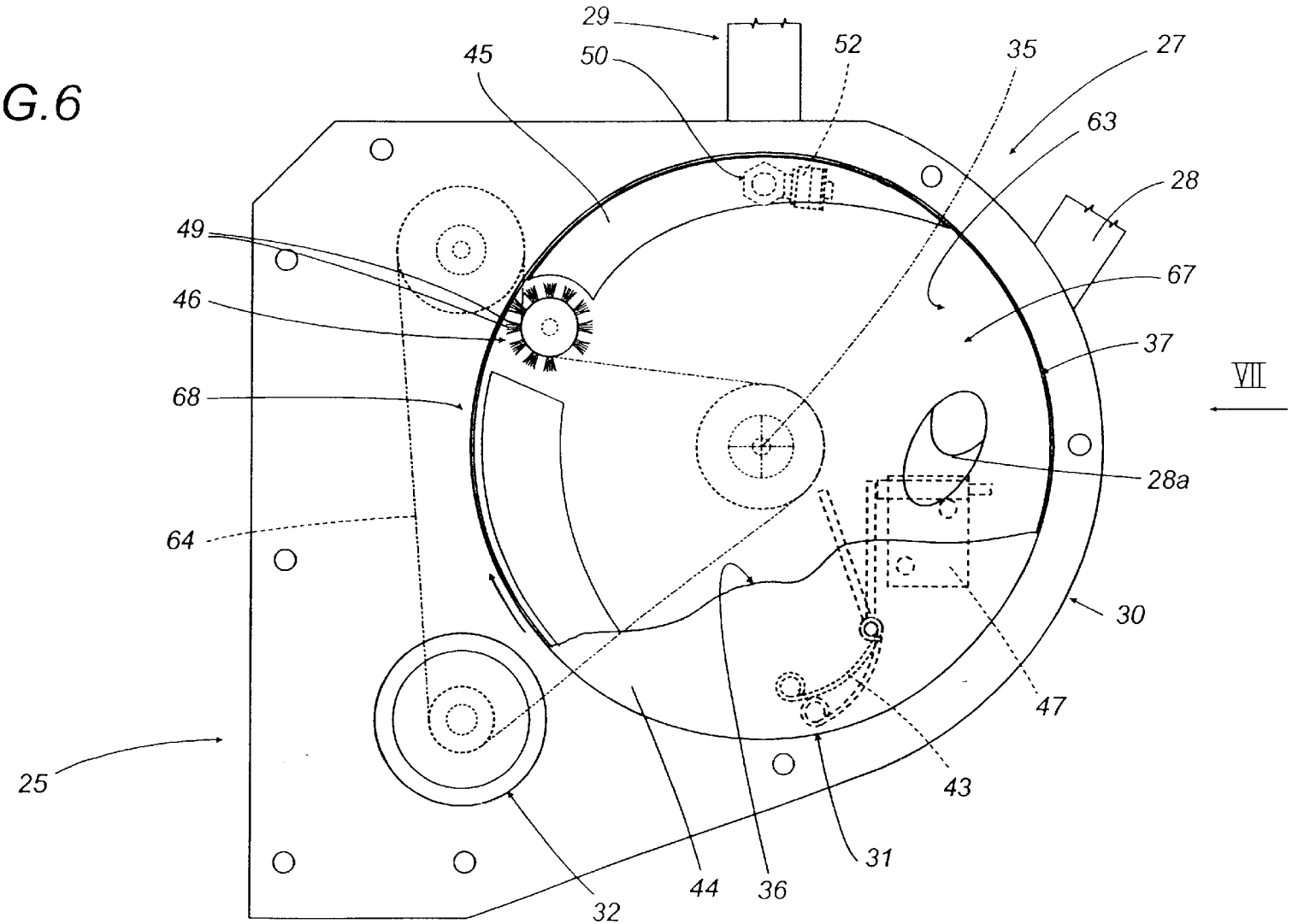
FIG. 6 is a schematic front view, with some parts in cross-section and others cut away for the purpose of clarity, of a second preferred embodiment of the device in accordance with the present invention.

The tank 26, for holding the particles 41 of the additive material, comprises a motor-driven screw feeder 26*a* at its base, which prevents agglomeration of the particles 41 of the additive material and feeds the distributor 27 through a delivery pipe 28, which ends at and is connected to the distributor 27 with an outlet 28*a*, as illustrated in FIGS. 3 and 6.

As illustrated in FIGS. 1, 3 and 6, the distributor 27 comprises a feed pipe 29 for feeding the particles of the additive material to the tobacco rod 14. The pipe 29 may end close to the outlet 5 of the ascending shaft 6, or it may end inside the ascending shaft 6 upstream of the outlet 5. In either case, the particles 41 of the additive material are introduced into the tobacco rod 14 in formation, so that at the beam 19 outfeed they are substantially positioned along the axis of the cigarette rod 20.

As illustrated in FIGS. 3, 6 and 7, the distributor 27 comprises a mobile conveyor 68 housed in a casing 30 and a motor 32 for driving the conveyor 68.

As illustrated in FIG. 7, the casing 30 comprises a cover 33 which may be removed in order to allow substitution of the conveyor 68 and, as is also illustrated in FIGS. 3 and 6, a circular wall 63 which closes one side of the conveyor 68 on the opposite side of the conveyor 68 to the cover 33. To facilitate removal of the cover 33 and allow substitution of the conveyor 68, the cover 33 is fixed to the casing 30 by means of screws 34 with ball-grips which can be unscrewed without tools.

As illustrated in FIGS. 3, 4, 6, and 7, the conveyor 68 comprises a hollow drum 31 which rotates about its axis 35 and is connected to the motor 32 by a belt 64 illustrated only in FIGS. 3 and 6 with a dashed line, and designed to transfer the rotary motion from the motor 32 to the conveyor 68. The drum 31 is hollow and consists of a flat base 36 and a cylindrical side wall 37 with seats 69 distributed along the entire wall 37 and designed to house the particles 41 of the additive material.

As shown in FIG. 7, the conveyor 68 is joined to a shaft 38 by a key or spline connection. To fix the conveyor 68 to the shaft 38, the latter has a threaded pin 38*a* onto which a nut 39 with a ball-grip is screwed, so that the conveyor 68 is integral with the shaft 38.

Figure 4:
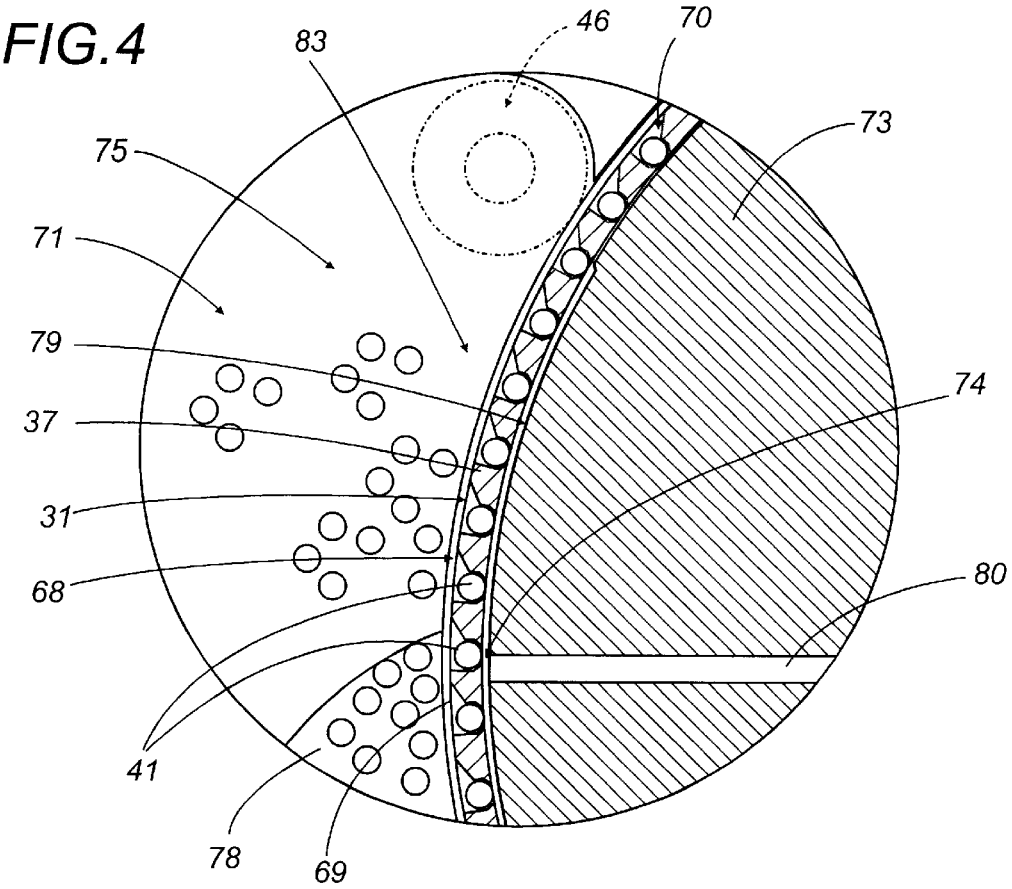
FIG. 4 is a scaled-up schematic cross-section, with some parts cut away, of a detail of the device illustrated in FIG. 3.
Figure 5:
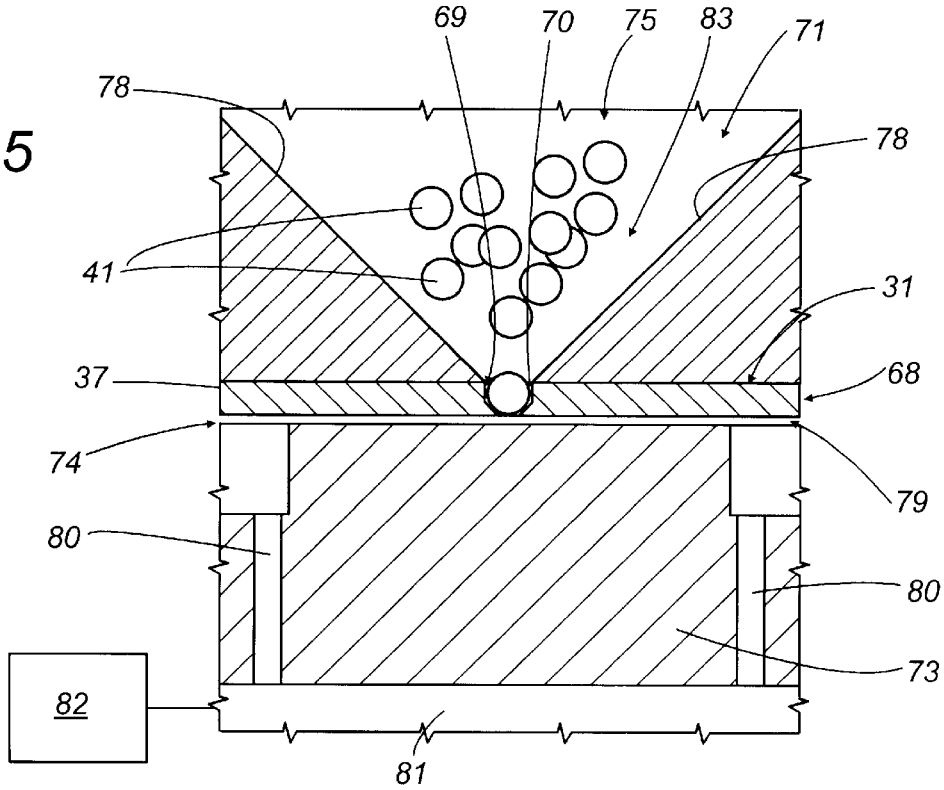
FIG. 5 is a scaled-up schematic cross-section along line V—V of the device illustrated in FIG. 3.

As illustrated in FIG. 7, the inside of the casing 30, the cover 33 and wall 63 constitute a fixed, cylindrical container structure 65 which houses the conveyor 68 with its drum 31. In particular, the structure 65 has a ring-shaped inner wall 66 with a diameter slightly larger than the outer diameter of the drum 31 and, precisely, the outer diameter of the side wall 37. In this way, the drum 31 can turn freely relative to the casing 30 and the cover 33 and relative to the circular wall 63 which closes the drum 31. As illustrated in FIGS. 3, 4 and 5, the seats 69, distributed along the entire cylindrical side wall 37 of the hollow drum 31, consist of cells 70 which are flared towards the outside of the drum 31 to form a guide for the infeed of the particles 41 into each cell 70. In the embodiment illustrated in FIGS. 3, 4 and 5, the distributor 27 comprises guide means for the particles 41, labeled 71 as a whole and comprising a buffer hopper 75 located outside the drum 31, comprising an inlet 76 connected to the outlet 28*a* of the pipe 28 which connects the hopper 75 to the tank 26. The hopper 75 also comprises an outlet 83 located at a portion of the outer surface of the cylindrical side wall 37 of the drum 31 and having a pair of walls 78 which converge towards the cells 70.

Inside the drum 31 there is a solid cylindrical body 73 whose dimensions substantially match the inner dimensions of the drum 31 and which is fixed relative to the latter. The cylindrical peripheral wall 77 of the body 73 which is opposite the inner surface of the cylindrical side wall 37 of the drum 31 has a gap 79 in the shape of a circular arc and made in such a way that it is longitudinal to and parallel with the axis 35 of the drum 31. Radial pipes 80 connect the gap 79 to a cylindrical manifold 81 which is coaxial to the drum 31 and connected to a suction source 82. As is more clearly illustrated in FIG. 5, the opposite ends of the gap 79 are open, meaning that it is in contact with the outside environment and provides limited suction through the cells 70, allowing them to hold the particles 41 correctly.

In particular, the gap 79, pipes 80, manifold 81 and suction source 82 together constitute suction means 74 which co-operate with the guide means 71 for inserting and holding the particles 41 of the additive material in the cells 70.

Downstream of the gap 79, relative to the direction of rotation of the drum 31 which, as illustrated in FIG. 3, rotates in a clockwise direction about its axis 35, the distributor 27 comprises a rotary brush 46 which is rotated, by means of the belt 64, by the same motor 32 which drives the rotation of the drum 31. The bristles 49 of the brush 46 act upon the outer surface of the side wall 37 and prevent the accumulation of too many particles 41 of the additive material in the cells 70 of the wall 37 of the drum 31.

Downstream of the brush 46 there is an arched sector 72 shaped in such a way that it matches the wall 37 and designed to define a fixed contoured surface for holding the particles 41 inside the cells 70 during rotation of the drum 31 before it reaches a pneumatic ejector unit 50 which allows the particles 41 to be ejected from distributor 27 and incorporated in the cigarette rod 20.

The pneumatic ejector unit 50 comprises a pressure regulator 52 which takes compressed air from a compressed air source (not illustrated) and adjusts the pressure to a suitable level for ejection of the particles 41 of the additive material from the cells 70.

In the embodiment illustrated in FIGS. 6 and 7, the drum 31 is hollow and consists of a flat base 36 and a cylindrical side wall 37 which, together with the closing wall 63, define a cavity 67 for holding and collecting the particles 41 of the additive material inside the drum 31.

In contrast to the embodiment illustrated in FIGS. 3, 4 and 5 described above, in the embodiment illustrated in FIGS. 6 and 7 the distributor 27 does not have the solid cylindrical body 73 and the tank 26 feeds the distributor 27 through the delivery pipe 28, which ends at and is connected to the distributor 27 by an outlet 28*a* made directly in the wall 63 of the drum 31 so that it gives directly onto the inside of the cavity 67.

The seats 69 in the side wall 37 of the drum 31 consist of cylindrical holes 40 whose diameter is slightly larger than the diameter of the particles 41 of the additive material which can run into the holes 40.

The particles 41 of the additive material inside the holes 40 in the drum 31 cannot exit the holes 40 because the play between the inner wall 66 of the container structure 65 and the outside of the drum 31 is less than the diameter of the particle 41.

For example, the play measured between the inner radius of the inner wall 66 of the container structure 65 and the outer radius of the drum 31 may be one tenth of the diameter of the particle 41 of the additive material.

The drum 31 also houses a pusher 43, two deflector elements 44, 45 and a rotary brush 46 with bristles 49. These elements promote the insertion of the particles 41 of the additive material in the holes 40 in the drum 31.

The pusher 43 is hinged on the casing 30 of the distributor 27 and can move between a position in which the drum 31 is partially full of particles 41 of the additive material and a position in which the drum 31 is completely empty. In the latter condition, the pusher 43 activates a filling sensor 47 which can emit an alarm signal and stop the cigarette making machine 1 by means of a control unit 58 controlled by the sensor 47.

Figure 9:
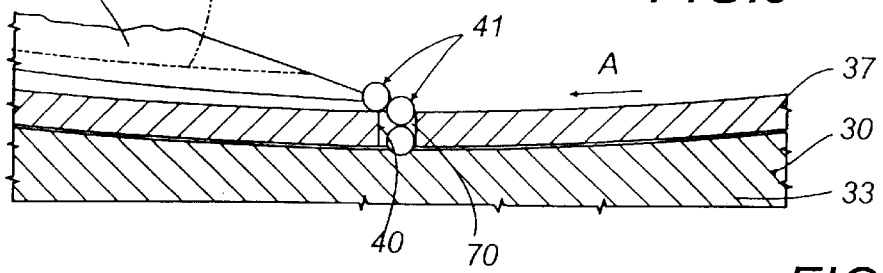
Figure 10:
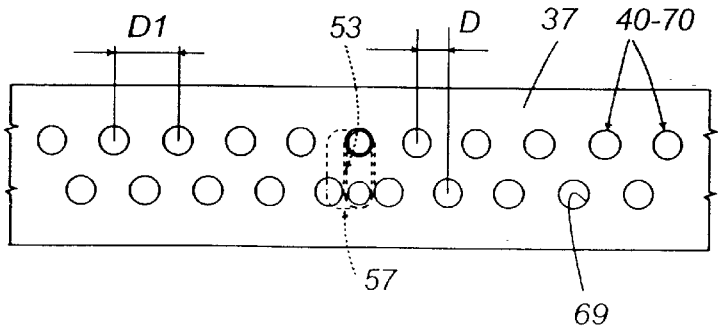
FIGS. 10 and 11 are partial front views of two embodiments of details illustrated in FIGS. 8 and 9.
Figure 12:
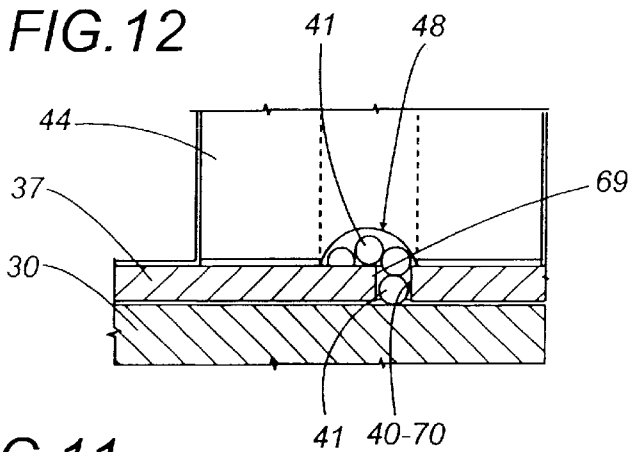
FIG. 12 is a side view, with some parts shown in cross-section, of details illustrated in FIG. 9.

As illustrated in FIGS. 6 and 10, the deflector elements 44 and 45, are substantially equal and have wedge-shaped sides, whilst FIG. 12 illustrates a view of the deflector 44 from A in FIG. 9, indicating a semi-circular channel 48 running the length of the deflectors 44 and 45.

As illustrated in FIGS. 9 and 12, the shapes of the deflector elements 44, 45 aid the insertion of the particles 41 in the holes 40 in the side wall 37 of the drum 31.

As illustrated in FIG. 6, the rotary brush 46 is located between the two deflector elements 44, 45. In this case too, the rotation of the brush is driven by the belt 64, by the same motor 32 which drives the rotation of the drum 31. Similarly to the two deflectors 44 and 45, the bristles 49 of the brush 46 aid the insertion of the particles 41 of the additive material in the holes 40 in the wall 37 of the drum 31. The second deflector element 45 is closer to the inner wall 37 of the drum 31 than the first deflector element 44, again promoting insertion of the particles 41 in the holes 40 in the wall 37 of the drum 31.

Insertion of the particles 41 is also aided by the centrifugal force created thanks to the rotation of the drum 31 about its axis 35.

In order to eject the particles from the distributor 27 and incorporate them in the cigarette rod 20, the distributor 27 comprises the above-mentioned pneumatic ejector unit 50 which, as illustrated in FIG. 6, is positioned close to the end 51 of the second deflector element 45.

As illustrated in FIGS. 3, 6, 7 and 8, the ejector unit 50 also comprises a nozzle 53 for supplying compressed air, positioned inside the drum 31 and a channel 54 for ejecting the particles 41 of the additive material, positioned outside the drum 31 on the same axis as the supply nozzle 53. The ejection channel 54 passes through the casing 30 of the distributor 27 and is, in turn, connected to the feed pipe 29, so as to transfer the particles 41 of the additive material to the tobacco rod 14.

In both of the embodiments illustrated in FIGS. 3, 4, 5 and respectively in FIGS. 6, 7, the seats 69, consisting of the cells 70 or holes 40 in the drum 31, may be arranged evenly over the circumference of the side wall 37. For example, as illustrated in FIG. 10, the seats 69 are arranged at a constant distance D1 from one another in two parallel rows, the seats 69 of one row being offset relative to the seats 69 of the other row by a distance D which is half of the distance D1 separating two consecutive seats 69 in one of the two rows.

The offset arrangement of the seats 69 allows the use of a smaller drum 31 with the same number of seats 69.

Figure 11:
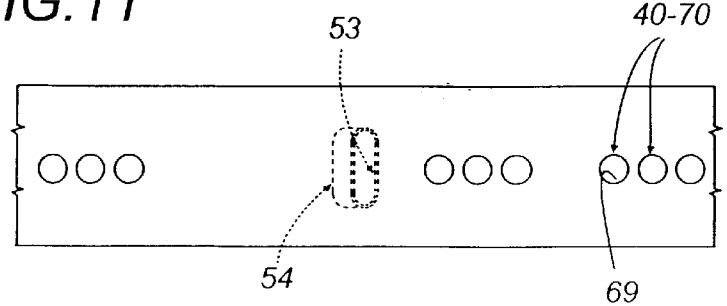

In another embodiment, illustrated in FIG. 11, the seats 69 are arranged at intervals which are not constant. This arrangement allows particles 41 of the additive material to be incorporated only in given zones 42 of the cigarette rod 20, as illustrated in FIG. 2.

For example, assuming that the peripheral speed of the drum 31 is equal to the cigarette rod 20 feed speed, the distance d between the particles of the additive material in the cigarette rod 20, indicated in FIG. 2, is equal to the distance D between the holes measured on the edge of the drum 31.

Therefore, by simply substituting the drum 31, it is possible to obtain different distributions of the particles of the additive material in the cigarette rod 20.

If an uneven distribution of particles 41 of the additive material in the cigarette rod 20 is required, and in particular the distribution of particles 41 at the start and at the end of the cigarette length 24, as illustrated in FIG. 2, the drum 31 must be synchronized with the rotary cutting device 23 in such a way that the cigarette rod 20 is cut precisely between two adjacent particle 41 zones 42.

For this reason, as illustrated in FIG. 1, there are sensor means 59 which detect the angular position of the drum 31 and of the rotary cutting device 23, and a control unit 58 which acts on the respective motor means, not illustrated, of the rotary cutting device 23 and on the motor 32 which drives the drum 31, synchronizing the device 23 and the drum 31.

Figure 8:
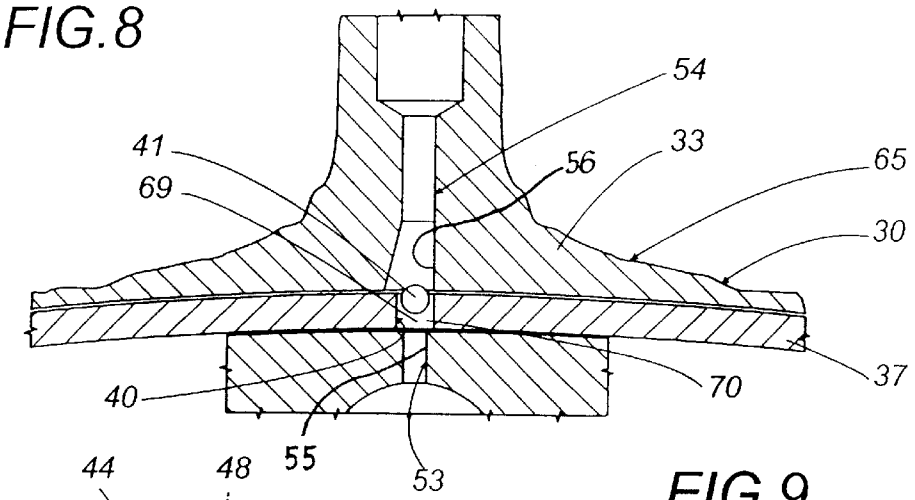
FIGS. 8 and 9 illustrate cross-sections of scaled-up details of the device in accordance with the present invention.

As illustrated in FIGS. 7 and 8, which may refer to both embodiments of the distributor 27, the end 55 of the compressed air supply nozzle 53 and the end 56 of the ejection channel 54 for the particles 41 of the additive material are close to the drum 31, allowing the drum to rotate but at the same time minimizing the pressure loss in the compressed air through the passages existing between the supply nozzle 53 and the drum 31, and between the drum 31 and the particle 41 ejection channel 54.

The end 55 of the supply nozzle 53, facing the drum 31, has a slot-shaped cross-section, so that it is wide enough to cover and surround both rows of seats 69, whether they consist of cells 70 or holes 40 in the side wall 37 of the drum 31. In this way, the particles 41 in both rows of seats 69 can be ejected.

However, since the seats 69 of one row are offset relative to the seats 69 of the other row, only one seat 69 is opposite the supply nozzle 53, therefore the particles 41 of the additive material are ejected one at a time.

As illustrated in FIGS. 10 and 11, the end 56 of the ejection channel 54 facing the drum 31 is shaped in such a way that it is wide enough to cover and surround both rows of seats 69 in the drum 31 and extends by a given measurement over the circumference of the drum 31. As indicated in FIG. 8, the ejection channel 54 has a tapered part with a decreasing cross-section, to aid the passage of the particle 41 of the additive material when it is ejected from the seat 69 in the drum 31. To check that the particle of the additive material has effectively been ejected, the feed pipe 29 is fitted with a first sensor 57, of the known type, which checks the passage of the particle 41 of the additive material in the pipe 29.

The first sensor 57 sends its signal to a control unit 58, which checks that the device 25 functions correctly. For this purpose, there may also be: a second sensor 59 for checking the speed of rotation and correct timing of the drum 31 in the distributor device 27, a third sensor 60 for checking the tobacco rod 14 feed speed along the vacuum conveyor 7, a fourth sensor 61 for checking the speed and timing of the rotary cutting device 23. As already indicated, the control unit 58 also receives the signal from the sensor 47 which detects the fill level of the cavity 67 in the drum 31.

When the control unit 58 detects incorrect parameters sent by the sensors, an alarm signal is issued and the cigarette making machine 1 is stopped.

As illustrated in FIGS. 1, 3, 6 and 7, the control unit 58 also controls and synchronizes the drum 31 with the rotary cutting device 23. In this way, the particles 41 of the additive material are incorporated in the cigarette rod 20 with a preset offset relative to the cigarette rod 20 cutting operation carried out by the rotary cutting device 23. As a result, the particles 41 of the additive material in each cigarette length 24 are positioned in a preset and constant manner relative to the transversal cutting lines 62.

In practice, the tank 26 is filled with the particles 41 of the additive material, the particles 41 are fed from the motor-driven screw feeder 26*a* through a delivery pipe 28 and arrive at the distributor 27.

In the embodiment illustrated in FIGS. 3, 4 and 5 the particles 41 pass through the inlet 76 and enter the hopper 75 which guides the particles 41 towards the portion of the outer surface of the wall 37 of the drum 31 through the two walls 78 converging towards the cells 70 and when the latter pass in front of the gap 79, the suction from the suction source 82 causes the particles to be inserted in the cells 70 and held there.

In the embodiment illustrated in FIGS. 6 and 7, the particles 41 exit the outlet 28*a* which is about half way up the distributor 27 and enter the cavity 67 in the drum 31.

In both embodiments, the drum 31 rotates at a given speed which is a function of the speed of the vacuum conveyor 7 and corresponds to the feed speed of the tobacco rod 14.

The feed speed of the tobacco rod 14 substantially corresponds with the speed of the cigarette rod 20. In addition, the peripheral speed and timing of the rotary cutting device 23 are the same as those of the drum 31 and match the feed speed of the tobacco rod 14 and cigarette rod 20.

In particular, as already indicated, the rotary cutting device 23 cuts the cigarette rod 20 when it is synchronized with the arrangement of the seats 69 of the distributor 27 drum 31.

For example, if a cigarette making machine cycle is defined as equal to a full cycle of the rotary cutting device 23, and if the device 23 is equipped with two blades positioned at 180 degrees to one another, during said cycle the device 23 makes two cuts along the transversal cutting lines 62 and two cigarette lengths 24 are obtained.

Thanks to the above-mentioned synchronization of the drum 31 and the cutting device 23, ejection of the particles 41 of the additive material from the seats 69 in the drum 31 and cigarette rod 20 cutting occur in such a way as to obtain a preset and cyclically constant positioning of the particles 41 relative to the transversal cutting lines 62 in each cigarette length 24.

In other words, the particles 41 in the cigarette rod 20 are always positioned at the same distance from the transversal cutting lines 62 and the number of particles present is always the same.

In the embodiment illustrated in FIG. 2, the particles 41 are ejected from the seats 69 in the drum 31 into the cigarette rod 20 at several zones 42 located in pairs close to and on opposite sides of the transversal cutting lines 62. In this way, each cigarette length 24 has the above-mentioned additive material particle 41 positioning zones 42 at its two opposite ends.

In the embodiment illustrated in FIGS. 6 and 7, once they have entered the cavity 67 in the drum 31, the particles 41 of the additive material are projected onto the inner surface of the cylindrical side wall 37 of the drum 31 by centrifugal force. The particles 41 are then pressed onto the inner surface of the wall 37 by the pusher 43, the two deflector elements 44, 45 and the rotary brush 46. These elements guarantee insertion of the particles 41 of the additive material in the holes 40 in the drum and filling of all holes 40 in the drum. The second deflector element 45, located after the rotary brush 46, eliminates the surface layer of particles 41 of the additive material, leaving only those particles 41 which are inside the holes 40.

In both of the above-mentioned embodiments, the particles 41 inside the holes 40 in the drum 31 then pass through the pneumatic ejector unit 50, in which a continuous jet of compressed air from the supply nozzle 53 ejects the particles 41 from both the cells 70 and the holes 40 in the drum 31 and blows them through the ejection channel 54 and the feed pipe 29 to the tobacco rod 14.

Operation of the distributor 27 is very reliable, since the particles are ejected by a continuous jet of compressed air, therefore, the particles 41 cannot jam due to pressure interruptions or changes. The pressure level can be adjusted and increased so as to obtain complete, safe ejection of all particles 41 present both in the cells 70 and in the holes 40 in the drum 31.

The distributor 27 also allows precision positioning of the particles 41 along the axis of the cigarette rod 20. The position of the particles 41 in the cigarette rod 20 and, therefore, in the cigarette lengths 24, depends only on the position of the seats 69 in the drum 31, since the tobacco rod 14 and the particles 41 in the holes in the drum 31 are moved at the same speed and, if necessary, the timing is controlled.

In order to change the positioning of the particles 41 of the additive material in the cigarette rod 20, it is therefore sufficient to substitute the drum 31 with another drum 31 on which the seats 69 are arranged differently, as illustrated for example in FIG. 11.

In another embodiment, different positioning of the particles 41 of the additive material in the cigarette rod 20 is obtained by cyclically changing the speed of the drum 31.

For example, to obtain the additive material particle arrangement illustrated in FIG. 2 with a drum 31 which has equidistant seats 69, the speed of rotation of the drum 31 may be reduced at those sections which must not contain particles, so that the cigarette rod 20 runs past without ejection of additive material particles.

In yet another embodiment of the present invention, instead of reducing the speed of rotation of the drum, it is possible to increase the speed of rotation of the drum 31 so as to bring the additive material particle steps closer together in those zones of the cigarette rod 20 where a greater density of the additive material is required.

What is claimed is:

1. A method for the production of a cigarette rod containing particles of an additive material, in a cigarette making machine, including stages of feeding particles of tobacco to a vacuum conveyor, moving at a given speed in order to form a continuous tobacco rod, incorporating the particles of the additive material in the tobacco rod as it is formed, feeding the tobacco rod to a continuous cigarette rod forming station, the particles of the additive material being positioned substantially along an axis of the cigarette rod, and cutting the cigarette rod into lengths using a rotary cutting device designed to cyclically cut the cigarette rod at transversal cutting lines, wherein the stage of incorporating the particles of the additive material in the tobacco rod comprises the stages of feeding the particles of the additive material to a distributor having a rotary conveyor with seats distributed on a cylindrical side wall thereof and ejecting the particles of the additive material towards the tobacco rod from the rotary conveyor through at least one ejection channel and wherein the seats in the cylindrical side wall consist of cells which are flared towards the outside and wherein the rotary conveyor rotates within a fixed ring-shaped structure.

2. The method according to claim 1, wherein the rotary conveyor rotates at a speed which is a function of the feed speed of the vacuum conveyor.

3. The method according to claim 2, wherein the rotary conveyor is a hollow drum and the movement of the rotary conveyor is achieved by causing the drum to rotate about its axis.

4. The method according to claim 1, wherein the stage of feeding the particles of the additive material to the distributor further comprises a stage of introducing the particles of the additive material into an inner cavity which is integral with the rotary conveyor for holding and collecting the particles of the additive material.

5. The method according to claim 1, wherein the stage of incorporating the particles of the additive material leads to a distribution of the particles along the axis of the cigarette rod which is a function of a speed at which the rotary conveyor moves.

6. The method according claim 1 wherein the stage of ejecting the particles of the additive is carried out pneumatically.

7. A method for the production of a cigarette rod containing particles of an additive material, in a cigarette making machine, including stages of feeding particles of tobacco to a vacuum conveyor, moving at a given speed in order to form a continuous tobacco rod, incorporating the particles of the additive material in the tobacco rod as it is formed, feeding the tobacco rod to a continuous cigarette rod forming station, the particles of the additive material being positioned substantially along an axis of the cigarette rod, and cutting the cigarette rod into lengths using a rotary cutting, device designed to cyclically cut the cigarette rod at transversal cutting lines, wherein the stage of incorporating the particles of the additive material in the tobacco rod comprises the stages of feeding the particles of the additive material to a distributor having a rotary conveyor with seats distributed on a cylindrical side wall thereof and ejecting the particles of the additive material towards the tobacco rod from the rotary conveyor through at least one ejection channel and wherein the rotary conveyor comprises a cylindrical side wall in which there are holes and wherein the rotary conveyor rotates within a fixed ring-shaped structure.

8. A method for the production of a cigarette rod containing particles of an additive material, in a cigarette making machine, including stages of feeding particles of tobacco to a vacuum conveyor, moving at a given speed in order to form a continuous tobacco rod, incorporating the particles of the additive material in the tobacco rod as it is formed, feeding the tobacco rod to a continuous cigarette rod forming station, the particles of the additive material being positioned substantially along an axis of the cigarette rod, and cutting the cigarette rod into lengths using a rotary cutting device designed to cyclically cut the cigarette rod at transversal cutting lines, wherein the stage of incorporating the particles of the additive material in the tobacco rod comprises the stages of feeding the particles of the additive material to a distributor having a rotary conveyor with seats distributed on a cylindrical side wall thereof and ejecting the particles of the additive material towards the tobacco rod from the rotary conveyor through at least one ejection channel and wherein the stage of feeding the particles of additive material to the distributor further comprises the stage of guiding the particles of the additive material by guide means which are fixed relative to the rotary conveyor and which open near to at least one portion of an outer surface of the cylindrical side wall, until the particles of the additive material are inserted in the seats.

9. The method according to claim 8, comprising a stage of inserting and holding the particles inside the seats by suction and a stage of holding the particles of the additive material in the seats with a fixed contoured surface.

10. The method according to claim 9, comprising a stage of collecting the particles of the additive material inside the fixed guide means.

11. A method for the production of a cigarette rod containing particles of an additive material, in a cigarette making machine, including stages of feeding particles of tobacco to a vacuum conveyor, moving, at a given speed in order to form a continuous tobacco rod, incorporating the particles of the additive material in the tobacco rod as it is formed, feeding the tobacco rod to a continuous cigarette rod forming station, the particles of the additive material being positioned substantially along an axis of the cigarette rod, and cutting the cigarette rod into lengths using a rotary cutting device designed to cyclically cut the cigarette rod at transversal cutting lines, wherein the stage of incorporating the particles of the additive material in the tobacco rod comprises the stages of feeding the particles of the additive material to a distributor having a rotary conveyor with seats distributed on a cylindrical side wall thereof, the seats comprising holes through the cylindrical side wall and ejecting the particles of the additive material towards the tobacco rod from the rotary conveyor through at least one ejection channel and comprising the further stages of creating a layer of particles of the additive material on an inner surface of the cylindrical side wall of the rotary conveyor;

inserting the particles of the additive material in the holes in the rotary conveyor, and providing an outer ring-shaped structure adjacent to the rotary conveyor to prevent the particles of the additive material from exiting the holes.

12. The method according to claim 11, comprising a stage of inserting and holding the particles of the additive material inside the holes using the centrifugal force created by rotation of the rotary conveyor.

13. A method for the production of a cigarette rod containing particles of an additive material, in a cigarette making machine, including stages of feeding particles of tobacco to a vacuum conveyor, moving at a given speed in order to form a continuous tobacco rod, incorporating the particles of the additive material in the tobacco rod as it is formed, feeding the tobacco rod to a continuous cigarette rod forming station, the particles of the additive material being positioned substantially along an axis of the cigarette rod, and cutting the cigarette rod into lengths using a rotary cutting device designed to cyclically cut the cigarette rod at transversal cutting lines, wherein the stage of incorporating the particles of the additive material in the tobacco rod comprises the stages of feeding the particles of the additive material to a distributor having a rotary conveyor with seats distributed on a cylindrical side wall thereof and ejecting the particles of the additive material towards the tobacco rod from the rotary conveyor through at least one ejection channel and wherein the stage of incorporating the particles of the additive material in the tobacco rod leads to a distribution of the particles along the axis of the cigarette rod which is a function of the position of the seats along the cylindrical side wall of the rotary conveyor, with the seats being arranged at intervals which are not constant.

14. A method for the production of a cigarette rod containing particles of an additive material, in a cigarette making machine, including stages of feeding particles of tobacco to a vacuum conveyor, moving at a given speed in order to form a continuous tobacco rod, incorporating the particles of the additive material in the tobacco rod as it is formed, feeding the tobacco rod to a continuous cigarette rod forming station, the particles of the additive material being positioned substantially along an axis of the cigarette rod, and cutting the cigarette rod into lengths using a rotary cutting device designed to cyclically cut the cigarette rod at transversal cutting lines, wherein the stage of incorporating the particles of the additive material in the tobacco rod comprises the stages of feeding the particles of the additive material to a distributor having a rotary conveyor with seats distributed on a cylindrical side wall thereof and ejecting the particles of the additive material towards the tobacco rod from the rotary conveyor through at least one ejection channel and wherein the stage of ejecting the particles of the additive material is followed by a stage of checking the presence of the particles along a feed pipe for the particles in a zone close to the vacuum conveyor.

15. A method for the production of a cigarette rod containing particles of an additive material, in a cigarette making machine, including stages of feeding particles of tobacco to a vacuum conveyor, moving at a given speed in order to form a continuous tobacco rod, incorporating the particles of the additive material in the tobacco rod as it is formed, feeding the tobacco rod to a continuous cigarette rod forming station, the particles of the additive material being positioned substantially along an axis of the cigarette rod, and cutting the cigarette rod into lengths using a rotary cutting device designed to cyclically cut the cigarette rod at transversal cutting lines, wherein the stage of incorporating the particles of the additive material in the tobacco rod comprises the stages of feeding the particles of the additive material to a distributor having a rotary conveyor with seats distributed on a cylindrical side wall thereof and ejecting the particles of the additive material towards the tobacco rod from the rotary conveyor through at least one ejection channel and wherein the stage of cutting the cigarette rod at the transversal cutting lines and the stage of ejecting the particles of the additive material are implemented cyclically, with a preset offset relative to each other, thus obtaining constant, preset positioning of the particles of the additive material relative to the transversal cutting lines in each cigarette length.

16. The method according to claim 15, wherein, in each cigarette length, the particles of the additive material are positioned in at least one preset zone relative to the transversal cutting lines.

17. The method according to claim 15, wherein, in each cigarette length, the particles of the additive material are positioned in respective preset zones, being arranged in pairs close to and on opposite sides of the transversal cutting lines, so that the zones in which the particles of the additive material are positioned are at the opposite ends of each cigarette length.

* * * * *